US011390366B2

(12) United States Patent
Cloutier et al.

(10) Patent No.: US 11,390,366 B2
(45) Date of Patent: Jul. 19, 2022

(54) ELECTRONIC CONTROL MODULE FOR ELECTRICALLY ASSISTED PEDAL-POWERED BOAT

(71) Applicant: PROPULSION POWERCYCLE INC., Saint-Georges (CA)

(72) Inventors: Benoit Cloutier, Saint-Georges (CA); Paul Laprade, Delson (CA)

(73) Assignee: PROPULSION POWERCYCLE INC.

( * ) Notice: Subject to any disclaimer, the term of this patent is extended or adjusted under 35 U.S.C. 154(b) by 29 days.

(21) Appl. No.: 17/248,493

(22) Filed: Jan. 27, 2021

(65) Prior Publication Data

US 2021/0229790 A1 Jul. 29, 2021

Related U.S. Application Data

(60) Provisional application No. 62/966,759, filed on Jan. 28, 2020.

(51) Int. Cl.

| | |
|---|---|
| ***B63H 21/20*** | (2006.01) |
| ***B63H 16/20*** | (2006.01) |
| ***B63H 21/21*** | (2006.01) |
| ***B63H 21/17*** | (2006.01) |

(52) U.S. Cl.

CPC ..... *B63H 21/20* (2013.01); *B63H 16/20* (2013.01); *B63H 21/17* (2013.01); *B63H 21/21* (2013.01); *B63H 2016/202* (2013.01); *B63H 2021/216* (2013.01)

(58) Field of Classification Search

CPC ..... B63H 21/21; B63H 21/20; B63H 21/17; B63H 16/20

See application file for complete search history.

(56) References Cited

U.S. PATENT DOCUMENTS

| | | | | |
|---|---|---|---|---|
| 6,855,016 | B1 | 2/2005 | Jansen | |
| 8,753,156 | B2 * | 6/2014 | Ketterman | B63H 25/42 440/26 |
| 9,988,133 | B2 * | 6/2018 | Murphy | B63H 16/18 |
| 10,266,237 | B2 * | 4/2019 | Zimmerman | B63H 21/17 |
| 2018/0251201 | A1 | 9/2018 | Murphy | |
| 2021/0229790 | A1 * | 7/2021 | Cloutier | B63H 16/20 |

* cited by examiner

*Primary Examiner* — S. Joseph Morano
*Assistant Examiner* — Jovon E Hayes
(74) *Attorney, Agent, or Firm* — Lavery, De Billy, LLP; Gonzalo Lavin

(57) ABSTRACT

An electronic control module (46) for coupling a pedal mechanically powered electric generator (28) and a battery (44) to a motor controller (48) of a watercraft propulsion motor (32), comprising: an electrical input operatively connected to the generator (28); a processor with a memory having an output operatively connected to the motor controller (46), said processor being operationally selectable by a user to one of multiple modes so that the processor being is configured to: in a first mode, combine power from the generator (28) with power from the battery (44) to power the motor (32); in a second mode, combine power from the generator (28) with partial power from the battery (44) to power the motor (32); and in a third mode, transfer power from the generator (28) to charge the battery (44).

12 Claims, 8 Drawing Sheets

ELECTRONIC CONTROL MODULE FOR ELECTRICALLY ASSISTED PEDAL-POWERED BOAT

CROSS REFERENCE TO RELATED APPLICATION

This application claims benefit, under 35 U.S.C. § 119(e), of U.S. provisional application Ser. No. 62/966,759, filed on Jan. 28, 2020, which is incorporated herein in its entirety by reference.

FIELD OF THE INVENTION

The present invention relates to a hybrid powertrain for boat or watercraft that combines a pedal-powered generator with a battery-powered electric motor.

BACKGROUND OF THE INVENTION

A multitude of pedal-powered watercraft (also referred to as water bikes, water-bicycles, and watercycles) are commercially available. Their main drawback is the relatively low power output capability of the operators. Unlike watercraft propelled by conventional combustion engines, pedal-powered watercraft are severely limited in power capability, which is typically less than 200 watts (around [¼] hp) per person on a continuous basis. A cyclist in good condition can generate around 200 watts at a preferred cadence of around 90-100 RPM.

There are also commercially available pedal-powered watercrafts that allow the use of an electric motor powered by a battery. However, these watercrafts do not use simultaneously both the human kinetic power and the battery power as in the case of known electrically assisted bicycles.

The main difficulty of a boat propulsion system is that it is difficult to effectively couple two driving forces that would have to accomplish the transmission of force on two different planes or axes unlike the electrically assisted bicycle. For example, on an electrically assisted bicycle at a speed of 25 km/h (15.5 miles/h), the wheel rotates typically at 250 RPM and the cyclist pedals at 60 RPM on average. It is therefore relatively easy to achieve a 3:1 overdrive. However, for a boat using an electric motor system the ratio required would be of about 40:1.

Most marine propellers use screw propellers with helical blades that rotate around an approximately horizontal axis defined by a propeller shaft. These screw propellers achieve great efficiency and ease of integration. However, these require high speeds of rotation and are unfortunately positioned at 90 degrees with respect to the axis of the pedal shaft. Mechanically, the construction of a system combining a propeller driven by electric propulsion motor and a mechanical pedaling system would substantially reduce the total efficiency of the system. For example, such 90 degrees positioning of the pedal with respect of the propeller typically reduces the efficiency by 17% while an overdrive system achieving 60 RPM at 2400 RPM typically reduces the efficiency by 15%. This would result in a loss of efficiency of 25% to 35%.

Also know is U.S. Pat. No. 6,855,016 (Jansen), which discloses a watercraft incorporating electrical power generation from human kinetic power, and electrical energy storage to enable amplification of human-power to propulsion power to achieve increased watercraft speeds. Control electronics enable operator-adjustable variable electronic gearing, and an assortment of torque vs. speed loading characteristics of the generator.

However, there is still a need in the field for an improved hybrid pedal powered and electrically assisted boat propeller system.

SUMMARY OF THE INVENTION

In order to address the above and other drawbacks, there is provided electronic control module for coupling a pedal mechanically powered electric generator and a battery to a motor controller of a watercraft propulsion motor, comprising: an electrical input operatively connected to the generator; a processor with a memory having an output operatively connected to the motor controller, said processor being operationally selectable by a user to one of multiple modes so that the processor being is configured to: in a first mode, combine power from the generator with power from the battery to power the motor; in a second mode, combine power from the generator with partial power from the battery to power the motor; and in a third mode, transfer power from the generator to charge the battery.

In embodiments, the control module is configured to determine a direction of rotation of the generator between a forward direction or a reverse direction; and to activate the motor in a same direction as the forward or reverse direction of the generator.

In embodiments, the control module comprises a comparator having inputs connected to electrical terminals of the generator and an output connected to an input of the motor controller for determining the direction of rotation of the generator.

In embodiments, a propeller assembly is operatively connectable to the electronic control module.

In embodiments, a pedal mechanism is operatively connectable to the propeller assembly.

According to the present invention, there is also provided a watercraft comprising: a mechanically powered generator; an electronic control module operationally connectable to the pedal powered generator; a battery operationally connectable to the electronic control module; a motor controller operationally connectable to the electronic control module; a propulsion motor operationally connectable to the motor controller for propelling the watercraft in forward or backward directions; wherein said processor is operationally selectable by a user to choose between one of multiple modes so that the processor is configured to: in a first mode, combine power from the generator with power from the to power the motor; in a second mode, combine power from the generator with partial power from the battery to power the motor; and in a third mode, transfer power from the generator to charge the battery.

In embodiments, the method comprises, by the electronic control module: determining the selected mode among the first, second and third modes; reading a current of the generator; comparing the current of the generator to a threshold value; if the current is above the threshold value then calculating a propulsion motor power command depending on the selected mode among the first, second and third modes; and transmitting the motor power command to the motor controller.

In embodiments, the method comprises, by the electronic control module: determining a direction of rotation of the generator between a forward direction or a reverse direction; activating the motor in a same direction as the forward or reverse direction of the generator.

In embodiments, the method comprises, in the first mode, combining up to 100% of available power of the generator with to up to 100% of available power of the battery to deliver up to 200% power to the motor.

In embodiments, the method comprises, in the second mode, combining up to a first percentage of available power of the generator with up to a second percentage of available power of the battery to deliver up to 100% of available power to the motor.

In embodiments, the first percentage of available power of the generator is up to 80% and the second percentage of available power of the battery is up to 20%.

In embodiments, the third mode transfers up 100% of available power of the generator to the battery.

Other objects, advantages and features of the present invention will become more apparent upon reading of the following non-restrictive description of specific embodiments thereof, given by way of examples only with reference to the accompanying drawings.

DETAILED DESCRIPTION

The present invention is illustrated in further details by the following non-limiting examples.

Figure 1:
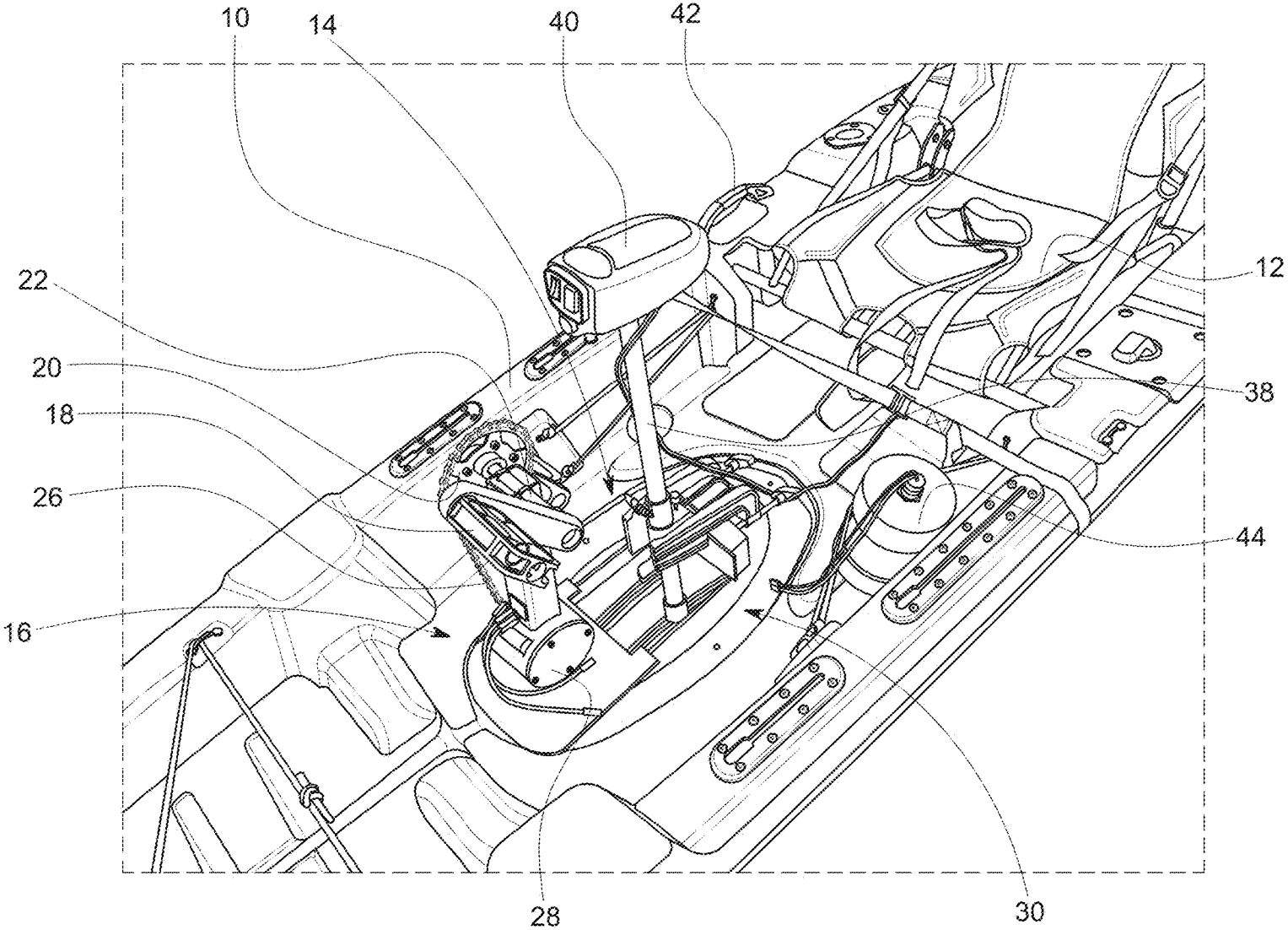
FIG. 1 is a perspective view of a watercraft including a pedal mechanism an electric control module, generator, motor controller, battery and motor, according to an illustrative embodiment of the present invention.

Referring to FIG. 1, there is shown a kayak or watercraft 10 with a seat 12 provided for the watercraft operator. Propulsion is accomplished via a centrally mounted propulsion unit 14. The propulsion unit 14 includes a foot pedal mechanism 16, similar to that of common bicycles, having a pedal 18 with a crank arm 20 that is operatively connected to a spindle 22 and chain wheel 24 about which is mounted a chain 26. The foot pedal mechanism 16 is operatively coupled to an electric generator 28 that is mechanically powered via the chain 26. It is also possible to have the pedal arms connected directly to the generator without the use of chain wheel and chain with proper generator winding configuration. The watercraft operator rotates the electric generator 28 by pedaling via the pedal 18. Mechanical power (i.e. kinetic energy) of the watercraft operator's pedaling action is converted to electrical power via the electric generator 28. Although a foot pedal 18 is shown, the electric generator 28 may instead be operatively connected to hand grips and positioned to utilize upper body motion, rather than leg motion. The electric generator 28 may be a brushless DC (BLDC) motor, such as for example having rating of 48 Volts and 500 Watts, but any other suitable generator may be used instead as persons skilled in the art will understand. A battery 44 is shown connected to the propulsion unit 14.

Figure 2:
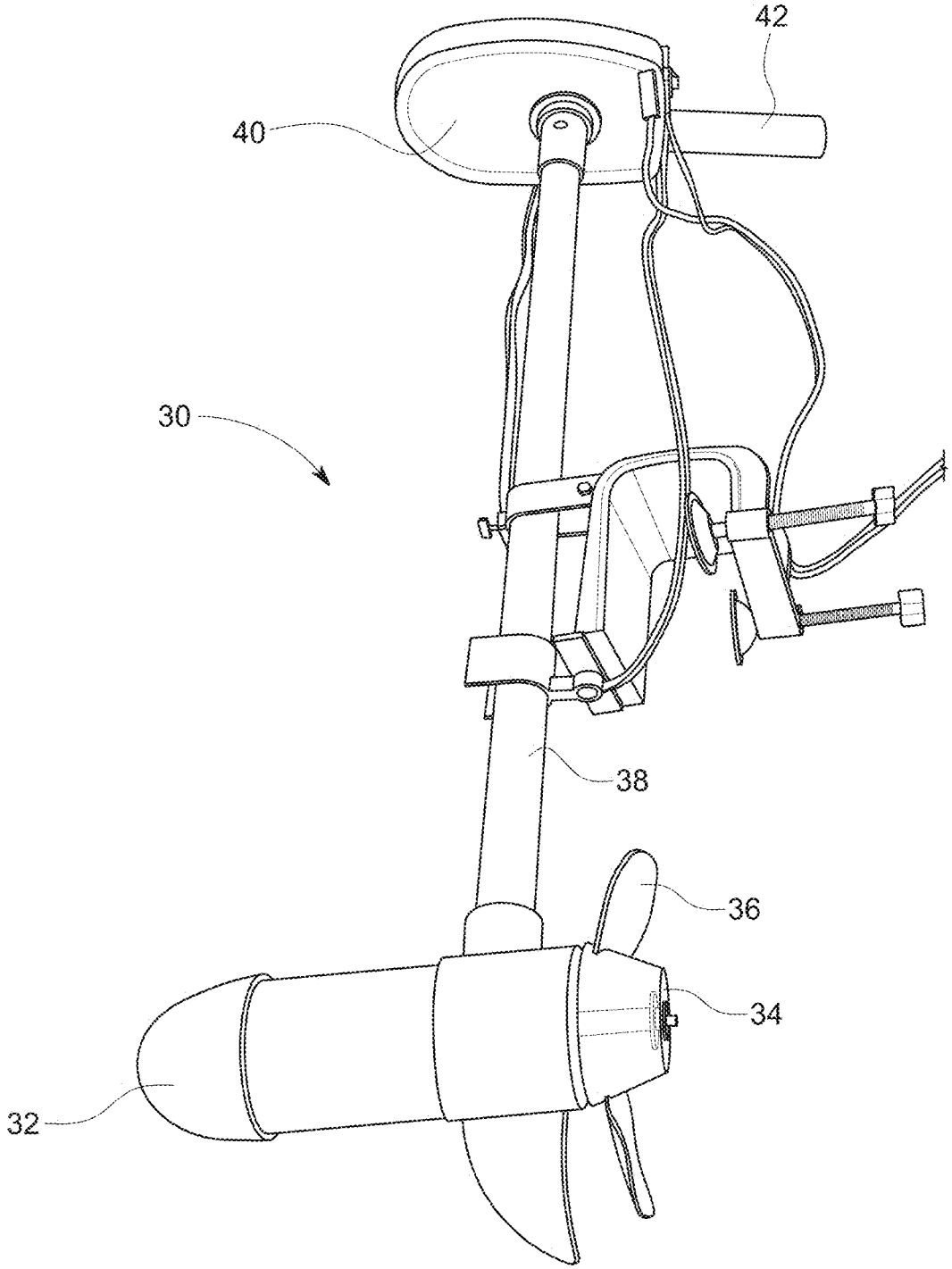
FIG. 2 is a perspective view of a propeller assembly, according to an illustrative embodiment of the present invention.

Referring now to FIG. 2, in addition to FIG. 1, the propulsion unit 14 also includes a propeller assembly 30 having an electric motor 32 operatively connected to a screw propeller 34 with helical blades 36. The electric motor 32 is shown mounted on a pivoting shaft 38 at one end thereof extending in a generally central position of the watercraft 10. The propeller assembly 30 may alternatively be fixedly mounted to the watercraft instead of being pivotably mounted and a separate rudder (not shown) may be used to direct the watercraft. A control console 40 is mounted on the other end of the pivoting shaft 38. A handle 42 is connected to the control console 40 for directing the screw propeller 34 towards different directions via the pivoting shaft 38.

Figure 3:
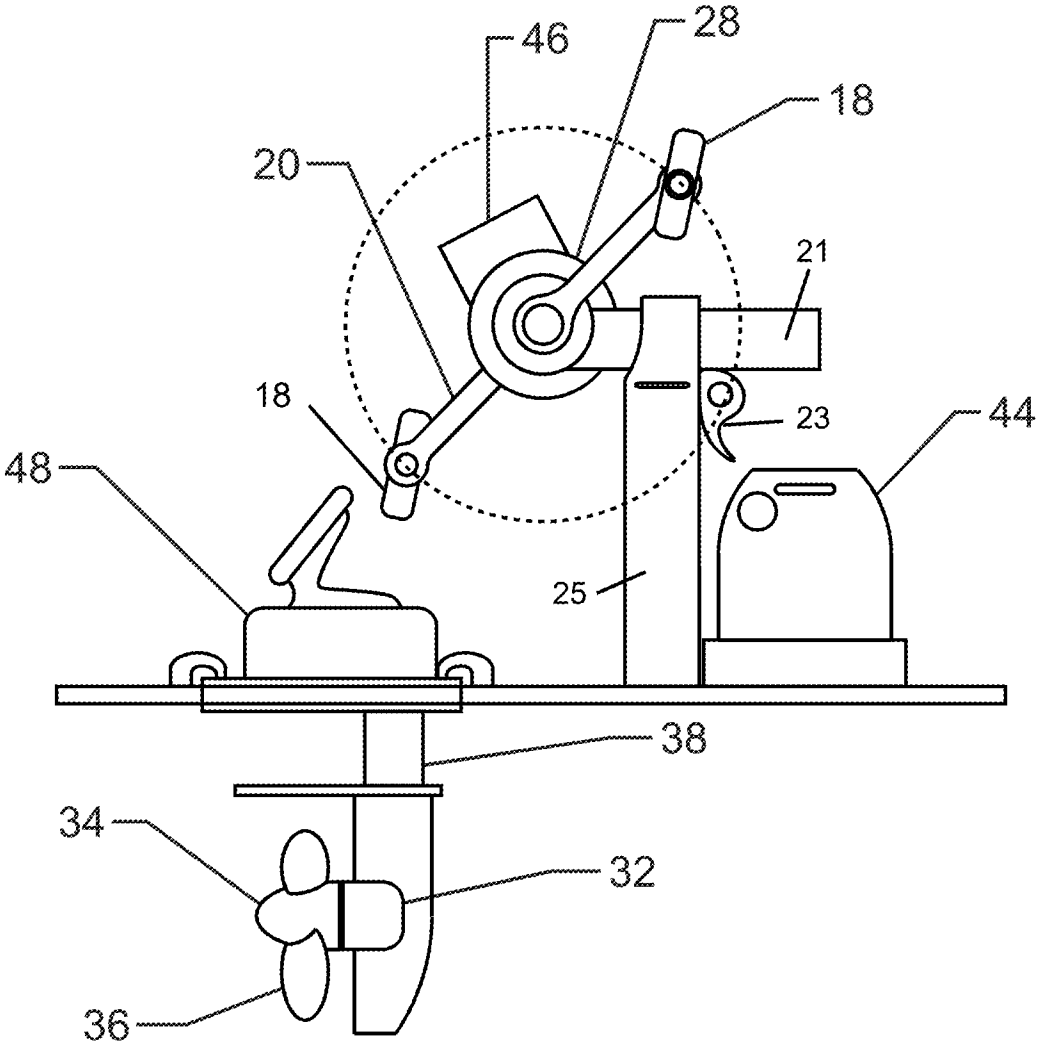
FIG. 3 is a side view of a propeller assembly, according to another illustrative embodiment of the present invention.

Referring now to FIG. 3, there is shown an alternative propulsion unit for a kayak or watercraft that is similar to the one shown in FIG. 1. The propulsion unit includes pedals 18 with a crank arm 20 that is directly connected to an electric generator 28. The watercraft operator rotates the electric generator 28 by pedaling via pedals 18. Mechanical power (i.e. kinetic energy) of the watercraft operator's pedaling action is converted to electrical power via the electric generator 28. In this embodiment, the electrical generator 28 is slidably mounted on a horizontally adjustable shaft 21 via a locking mechanism 23 for locking in position the shaft 21 with respect to a vertical shaft 25. The adjustable shaft 21 is especially useful in watercrafts or kayaks where the seats are not adjustable horizontally and allow for operators with different leg lengths to comfortably adjust the pedal distance. Similarly, as in FIG. 1, the propulsion unit also includes a propeller assembly having an electric motor 32 operatively connected to a screw propeller 34 with helical blades 36. A battery 44 is electrically connected to the propulsion unit. A motor controller 48 is shown above shaft 38 that links the motor controller 48 to the electric motor 32.

Figure 4:
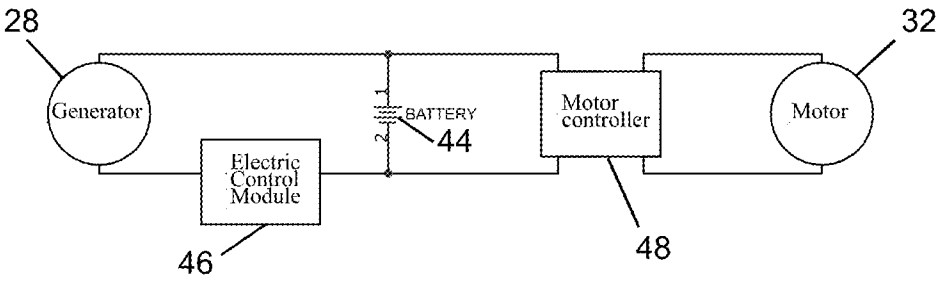
FIG. 4 is a schematic block diagram of electric components used for controlling the propulsion of a watercraft, in accordance with an illustrative embodiment of the present invention.

Referring now to FIG. 4, in addition to FIGS. 1 to 3, there is shown some of the electric components of the propeller assembly 30 that are used for controlling the propulsion of the watercraft 10. As can be seen, the electric generator 28 is not mechanically connected to the motor 32, which is advantageous over know prior art watercraft propeller systems described in the background section where it was explained that it is difficult to effectively couple two driving forces that would have to accomplish the transmission of force on two different planes or axes.

A battery 44, such as a lithium oxide battery or any suitable kind of batteries, is operatively electrically connected to the electric generator 28 for storing the power generated by the pedaling action of the foot pedal mechanism 16.

Referring back to FIGS. 3 and 4, an electric control module 46 is shown operatively connected to the electric generator 28 and a motor controller 48 is shown operatively connected to the electric motor 32.

Figure 5:
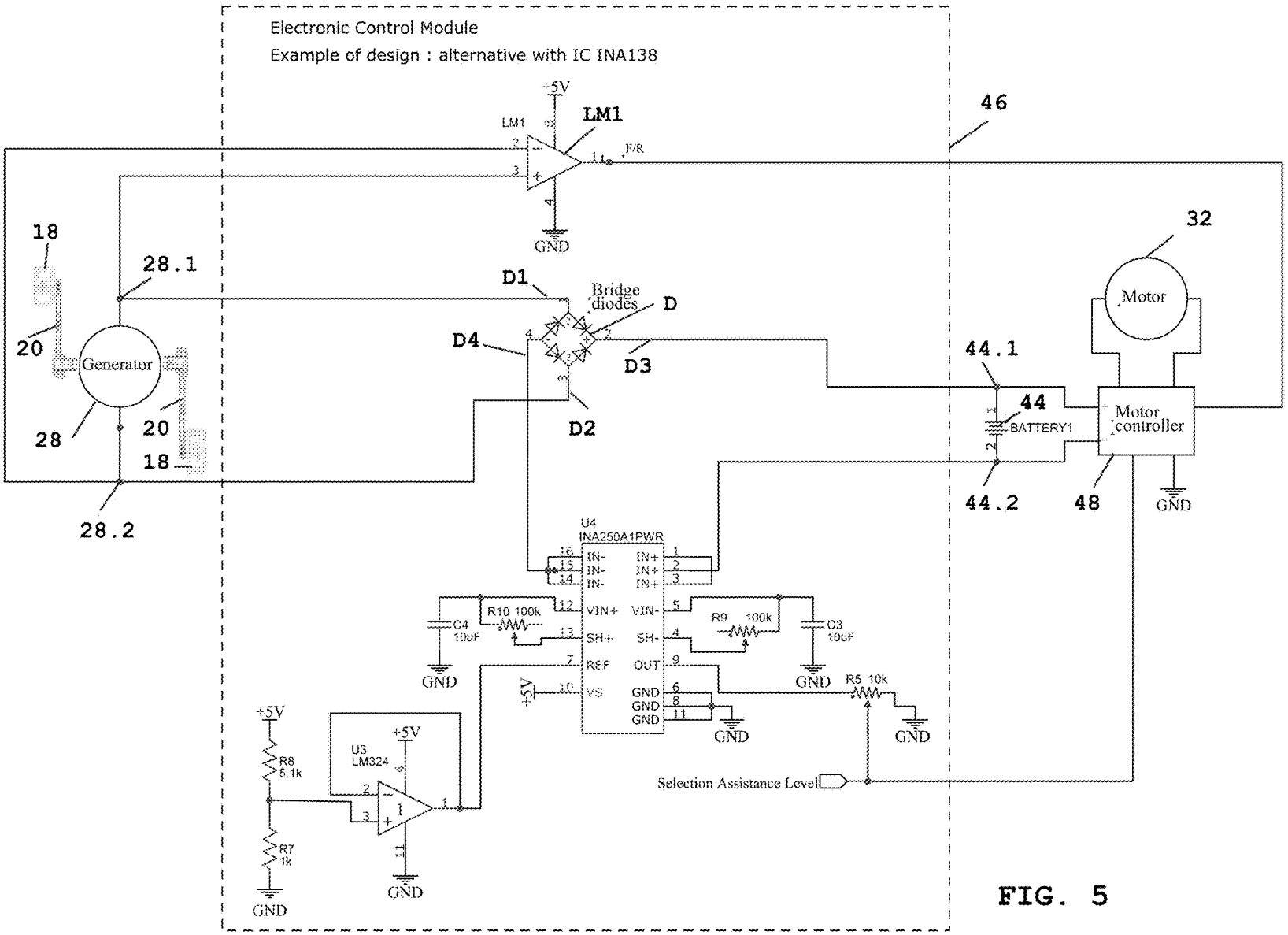
FIG. 5 is schematic block diagram of electric components for controlling the propulsion of a watercraft, in accordance with an illustrative embodiment of the present invention.

Referring now to FIG. 5, in addition to FIGS. 1 to 4, there is shown a more detailed schematic diagram of components of a propulsion system, according to a preferred embodiment. The electric control module 46 is shown operatively connected to the electric generator 28 with pedals 18 and crank arms 20. The electronic module 46 is also operatively connected to the motor controller 48, which is shown connected to the electric motor 32. The electronic control module 46 includes a comparator LM1 that has its two inputs respectively connected to the generator 28 at terminals 28.1 and 28.2. The output of the comparator LM1 is connected to an input of the motor controller 48. The electronic control module 46 includes a rectifying diode bridge D for converting AC power from the generator 28 to DC power for powering the battery 44, and motor 32. The diode bridge D has four diodes with two AC terminals D1, D2 respectively connected across terminals 28.1 and 28.2 of the generator 28. The diode bridge D has a positive terminal D3 connected to a positive terminal of the motor controller 48 and to a positive terminal 44.1 of battery 44. The diode bridge D has a negative terminal D4 connected to a first input (14, 15, 16) of an integrated circuit U4 (INA250A1PWR), which includes a processor with a memory. A second input (1, 2, 3) of the integrated circuit U4 is connected to a negative terminal 44.2 of the battery 44 and to a negative terminal of the motor controller 48. An output 9 of the integrated circuit U4 is connected to an input of the motor controller 48 for allowing a selection of the power assistance level that is controlled by the user to provide power from the generator 28 to the motor 42.

Figure 6:
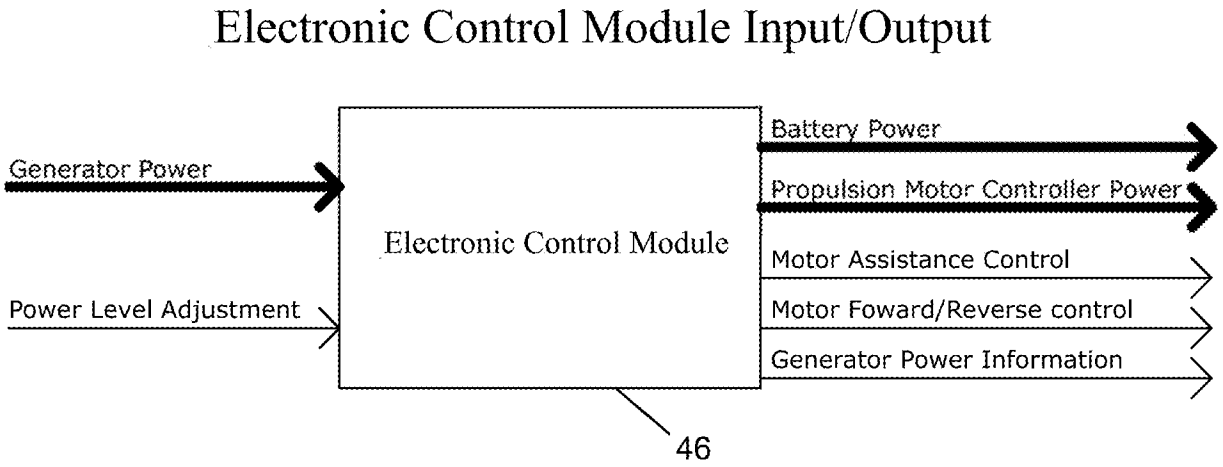
FIG. 6 is schematic block diagram illustrating various inputs and outputs of the electronic control module, in accordance with an illustrative embodiment of the present invention.

Referring now to FIG. 6, in addition to FIGS. 1 to 5, there is shown the different inputs and outputs of the electric control module 46. Inputs include generator power from electric generator 28 and power level adjustment. Outputs include battery power to the battery 44, propulsion motor controller power to the motor controller 48, motor assistance control, motor forward/reverse control and generator power information.

Figure 7:
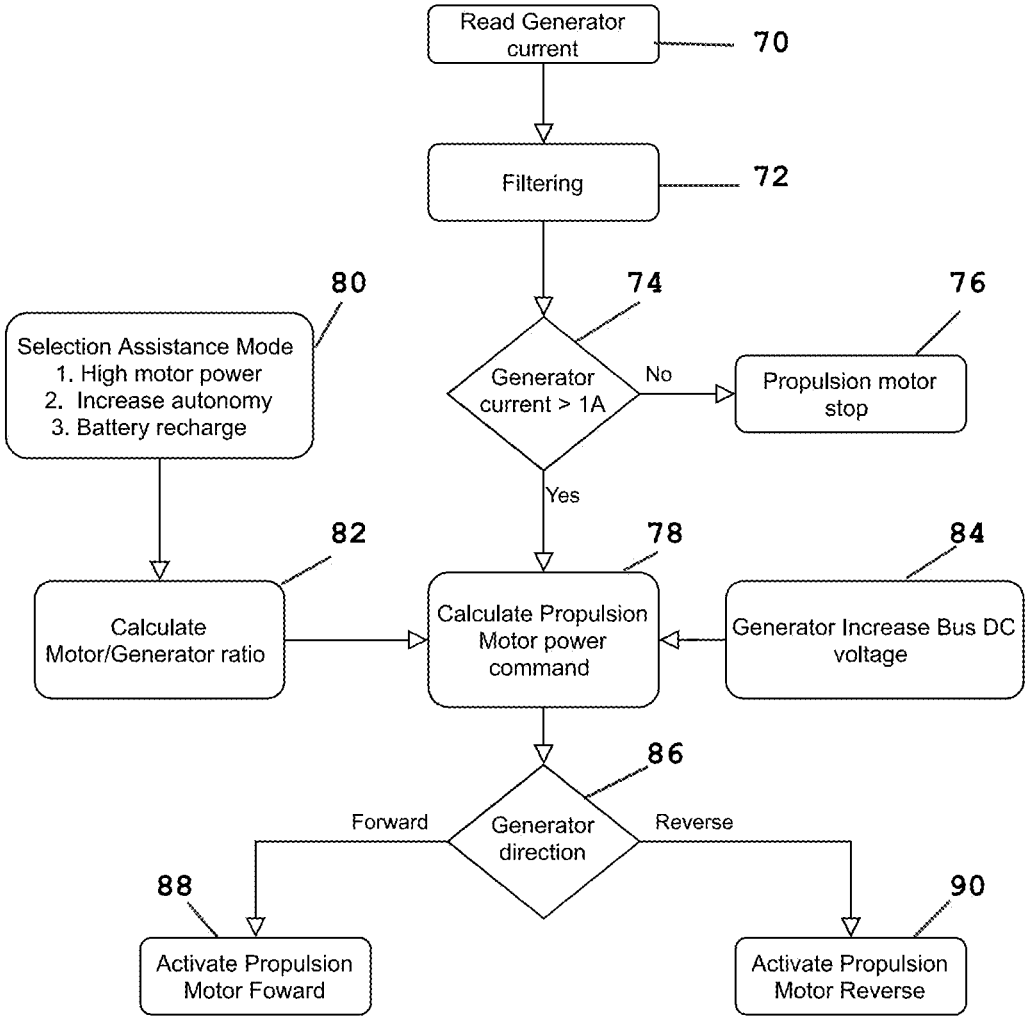
FIG. 7 is schematic flow diagram of a method for operating a system, according to an illustrative embodiment of the present invention.

Referring now to FIG. 7, in addition to FIGS. 1 to 6, there is shown a schematic flow diagram of a method for operating a system including the electronic control module 46 for coupling the pedal powered generator 28 to the motor controller 48 of the watercraft motor 32, according to a preferred embodiment. The method begins operation by reading a current from generator 28 at step 70. A filtering of the current is performed at step 72. The filtered current of the generator 28 is compared against a threshold value, for example 1 A, at step 74. If the filtered current of the generator 28 is lower than 1 A then the propulsion motor 32 is stopped at step 76. If the current of the generator is greater than 1 A, then the method continues by calculating the propulsion motor power command sent by the electronic control module 46 to the motor controller 48 at step 78. The calculation of the propulsion motor power command is determined according to the selection of assistance mode at step 80 that is used to calculate the motor/generator ratio at step 82. The selection of assistance mode at step 80 includes the selection of: 1. High motor power mode; or 2. Increase autonomy mode; or 3. Battery recharge mode. Another input parameter for calculating the propulsion motor power command involves receiving a value of the generator increase bus DC voltage at step 84. The propulsion motor power command obtained at step 78 is then compared with a general direction at step 86. If the motor power command corresponds to a forward direction then the motor controller 48 activates the propulsion motor 32 to forward at step 88. If the motor power command corresponds to a reverse direction then the motor controller 48 activates the propulsion motor 32 to reverse at step 90.

The power provided by the generator 28 to the motor 32 can be calculated according to the following formula:

$$P_{motor}=P_{Generator}*A$$

where $P_{motor}$ is the power of motor propulsion in Watts (W). $P_{Generator}$ is the power generated by the pedaling user in Watts (W) A is the assistance factor, which may be for example from 0 to 300%.

The energy provided by the generator 28 to the battery 44 can be calculated according to the following formula:

$$E_{Battery}=E_{Generator}-E_{Motor}$$

where $E_{Battery}$ is the energy of the battery 44, $E_{Generator}$ is the energy of the generator 28 and $E_{Motor}$ is the energy of the motor 32, in Watts-hour (Wh).

The power of the generator 28 is calculated according to the following formula:

$$P_{Generator}=0 \text{ if } RPM_{Generator}<RPM_{Minimum}$$

where $RPM_{Generator}$ is the rotation per minute (rpm) of the generator 28, and $RPM_{Minimum}$ is the minimum rotation per minute (rpm) of the generator 28 for producing energy.

The maximum power provided by to the motor 32 by the generator 28 can be calculated according to the following formula:

$$MaxP_{Motor}=I_{Motor}*(VOC_{Battery}+R_{INT}*(I_{Generator}-I_{Motor}))$$

where $MaXP_{motor}$ is the maximum power available for the propulsion motor 32 in Watts (W), $I_{Motor}$ is the current of the motor 32 in Amps (A), $VOC_{Battery}$ is the voltage charge of the battery 44 in Volts (V), $R_{INT}$ is the internal resistance of the battery 44 in Ohms (Ω), $I_{Generator}$ is the current of the generator 28 in Amps (A).

The direction of rotation of the motor 32 is in the same direction as the direction of rotation of the generator 28, which is determined by the electronic control module (46) by means of the comparator (LM1).

Figure 8:
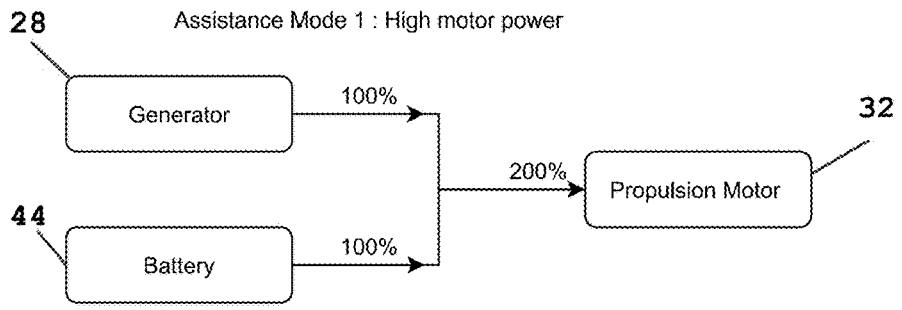
FIG. 8 is a schematic diagram of operation of the system in a first mode, according to an illustrative embodiment of the present invention.

Referring to FIG. 8, in addition to FIGS. 1 to 7, there is shown a schematic diagram of operation of the system in an Assistance Mode 1: "High motor power" where both the generator 28 and battery 44 provide 100% of their available power to the propulsion motor 32 to achieve 200% of available power.

Figure 9:
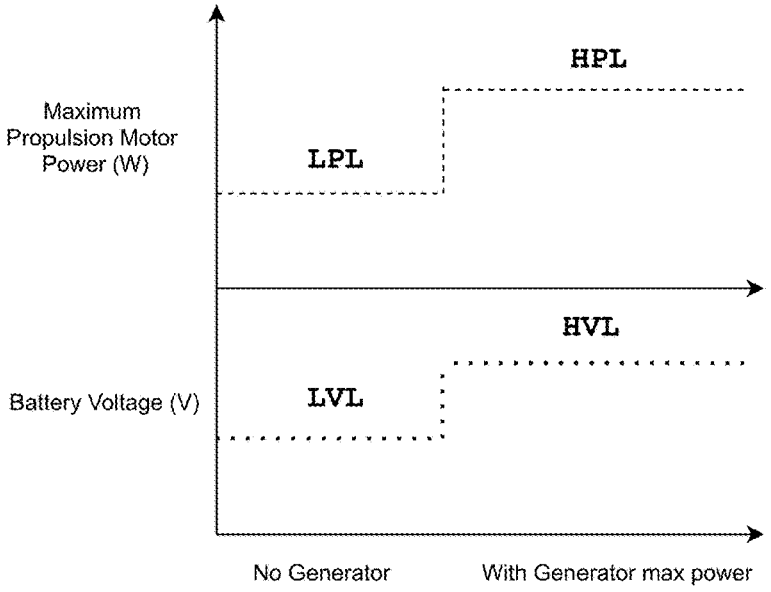
FIG. 9 is a schematic graphic of the maximum power and voltage of the propulsion motor with or without assistance from a generator, according to an illustrative embodiment of the present invention.

Referring to FIG. 9, in addition to FIGS. 1 to 8, there is shown a schematic graphic of the maximum power $MaXP_{Motor}$ provided by to the motor 32 and the voltage of the battery 44 with no input power provided by the generator 28 to achieve a low power level LPL and low voltage level LVL, which is contrasted with the input power provided by the generator 28 to achieve a high power level HPL and high voltage level HVL.

Figure 10:
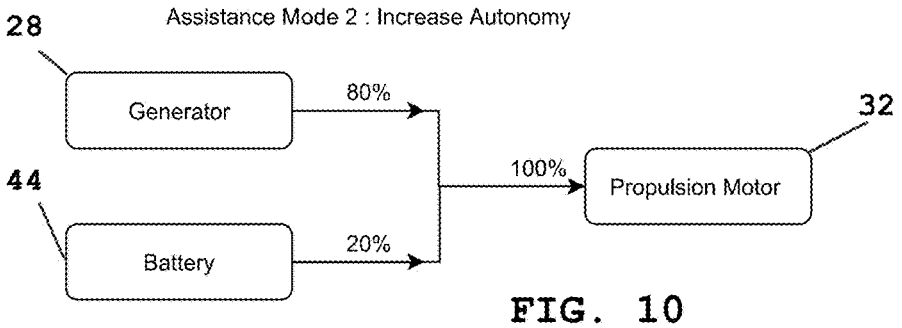
FIG. 10 is a schematic diagram of operation of the system in a second mode, according to an illustrative embodiment of the present invention.

Referring to FIG. 10, in addition to FIGS. 1 to 9, there is shown a schematic diagram of operation of the system in an Assistance Mode 2: "Increase Autonomy" where the generator 28 provides 80% of the power and the battery 44 provides 20% of the power to achieve 100% of available power to the propulsion motor 32.

Figure 11:
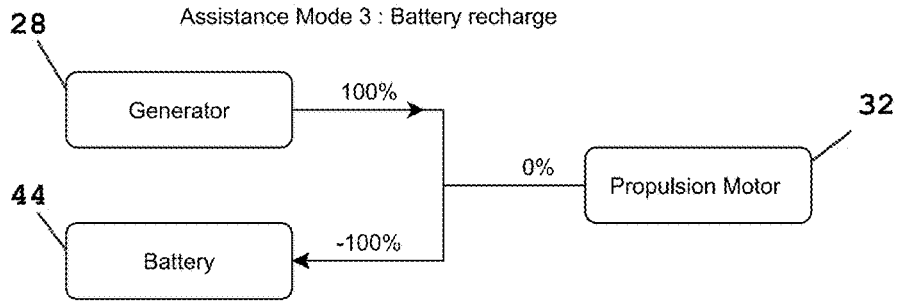
FIG. 11 is a schematic diagram of operation of the system in a third mode, according to an illustrative embodiment of the present invention.

Referring to FIG. 11, in addition to FIGS. 1 to 10, there is shown a schematic diagram of operation of the system in an Assistance Mode 3: "Battery recharge" where the generator 28 provides 100% of the power and the battery 44 receives 100% of the power, while the propulsion motor 32 receives 0% of the power.

In embodiments, the system according to the present invention combines nautical electric propulsion from the electric motor 32 with that of a human being via the pedal assembly 16 and electric generator 28. This makes it possible to add the human force to the electric power. For example, 500 Watts of electric propulsion+250 Watts of human power=750 Watts of total power.

In embodiments, the system according to the present invention optimizes the pedal's speed and effort to adapt to different users with different physical conditions.

In embodiments, the system of the present invention effectively allows for the combination of electric boat propulsion with human propulsion effort.

In embodiments, the system of the present invention advantageously eliminates the need for an extensive mechanical overdrive.

In embodiments, the system of the present invention allows an electrical connection only between the electrical components. It thereby enables ease of integration.

In embodiments, the system of the present invention is advantageously modular. The electric propulsion module can be used without the generator and with almost any type of battery.

In embodiments, the system of the present invention allows for several choices of techniques for using the system:

Combined mode Human power+electric=Faster.

Generator mode: Allows charging the battery.

Battery Only Mode: No need to pedal

Forward and reverse motion can be accomplished by reversing the pedals rotation or by using the forward or reverse option on the display of the control console 40 that is operatively connected to the electric control module 46.

Only Human Mode: No need for battery power.

The electronic control module 46 allows among other things to have different levels of electrical assistance.

The scope of the claims should not be limited by the preferred embodiments set forth in the examples, but should be given the broadest interpretation consistent with the description as a whole.

The invention claimed is:

1. An electronic control module for coupling a mechanically powered electric generator and a battery to a motor controller of a watercraft propulsion motor, comprising:

an electrical input operatively connected to the generator;

a processor with a memory having an output operatively connected to the motor controller, said processor being operationally selectable by a user to one of multiple modes so that the processor is configured to:

in a first mode, combine power from the generator with power from the battery to power the motor;

in a second mode, combine power from the generator with partial power from the battery to power the motor; and in a third mode, transfer power from the generator to charge the battery.

2. The electronic module of claim 1, wherein the control module is configured to determine a direction of rotation of the generator between a forward direction or a reverse direction; and to activate the motor in a same direction as the forward or reverse direction of the generator.

3. The electronic module of claim 2, comprising a comparator having inputs connected to electrical terminals of the generator and an output connected to an input of the motor controller for determining the direction of rotation of the generator.

4. A propeller assembly operatively connectable to the electronic control module of claim 1.

5. A pedal mechanism operatively connectable to the propeller assembly of claim 4.

6. A watercraft comprising:

a mechanically powered generator;

an electronic control module operationally connectable to the mechanically powered generator;

a battery operationally connectable to the electronic control module;

a motor controller operationally connectable to the electronic control module;

a propulsion motor operationally connectable to the motor controller for propelling the watercraft in forward or backward directions;

a processor with a memory having an output operatively connected to the motor controller;

wherein said processor is operationally selectable by a user to choose between one of multiple modes so that the processor is configured to:

in a first mode, combine power from the generator with power from the battery to power the motor;

in a second mode, combine power from the generator with partial power from the battery to power the motor; and in a third mode, transfer power from the generator to charge the battery.

7. A method of operation of the watercraft of claim 6, comprising:

by the electronic control module:

determining the selected mode among the first, second and third modes;

reading a current of the generator;

comparing the current of the generator to a threshold value;

if the current is above the threshold value then calculating a propulsion motor power command depending on the selected mode among the first, second and third modes; and transmitting the motor power command to the motor controller.

8. The method of claim 7, comprising, by the electronic control module: determining a direction of rotation of the generator between a forward direction or a reverse direction; activating the motor in a same direction as the forward or reverse direction of the generator.

9. The method of claim 7, wherein the first mode combines up to 100% of available power of the generator with to up to 100% of available power of the battery to deliver up to 200% power to the motor.

10. The method of claim 7, wherein the second mode combines up to a first percentage of available power of the generator with up to a second percentage of available power of the battery to deliver up to 100% of available power to the motor.

11. The method of claim 10, wherein the first percentage of available power of the generator is up to 80% and the second percentage of available power of the battery is up to 20%.

12. The method of claim 7, wherein the third mode transfers up 100% of available power of the generator to the battery.

* * * * *